US007878102B1

(12) United States Patent
Dubois et al.

(10) Patent No.: US 7,878,102 B1
(45) Date of Patent: Feb. 1, 2011

(54) REVOLVER FOR FIRING HIGH VELOCITY AMMUNITION

(75) Inventors: Jason Robert Dubois, North Smithfield, RI (US); Simon Micheal Muska, Enfield, CT (US); Gary E. Zukowski, Indian Orchard, MA (US); John W. Avedisian, Windsor, CT (US); Brett Curry, Chicopee, MA (US)

(73) Assignee: Smith & Wesson Corp., Springfield, MA (US)

( * ) Notice: Subject to any disclaimer, the term of this patent is extended or adjusted under 35 U.S.C. 154(b) by 802 days.

(21) Appl. No.: 11/750,445

(22) Filed: May 18, 2007

Related U.S. Application Data

(63) Continuation of application No. 11/270,944, filed on Nov. 10, 2005, now Pat. No. 7,254,913.

(60) Provisional application No. 60/627,491, filed on Nov. 12, 2004.

(51) Int. Cl.
*F41C 3/14* (2006.01)

(52) U.S. Cl. ..... 89/26; 42/65

(58) Field of Classification Search ..... 42/65, 42/66, 67; 89/26
See application file for complete search history.

(56) References Cited

U.S. PATENT DOCUMENTS 2,805,604 A * 9/1957 Humphrey ..... 89/135
3,049,977 A * 8/1962 Reich ..... 89/154
3,170,261 A * 2/1965 Ludovici ..... 42/59
4,253,261 A 3/1981 Schmidt
4,621,445 A * 11/1986 Rohm ..... 42/66
4,690,737 A 9/1987 Vishnitsky
H1365 H 11/1994 Amspacker et al.
5,604,326 A * 2/1997 Lescure ..... 89/26
5,802,757 A 9/1998 Duval et al.
5,819,400 A 10/1998 Sargeant
6,330,761 B1 12/2001 Duval et al.
6,523,294 B2 2/2003 Curry et al.

* cited by examiner

*Primary Examiner*—Stephen M Johnson
(74) *Attorney, Agent, or Firm*—McCormick, Paulding & Huber LLP

(57) ABSTRACT

A revolver for firing high velocity ammunition includes a frame, a cylinder, a barrel, and a firing mechanism. The revolver may include one or more of the following, each of which is especially adapted for use in the context of firing high velocity ammunition: spacers for adjusting a barrel-cylinder gap, for eliminating broaching of the rearward surface(s) of the barrel; a forcing cone formed in the rearward opening of the barrel for accommodating deformed projectiles; a reflective surface (e.g., mirrored surface) provided on the cone and/or barrel rearward surfaces, for reducing erosion resulting from using high velocity ammunition; gain-twist rifling in the barrel for a smoother transition to full projectile velocity; a larger diameter, hardened firing pin bushing for minimizing brass flow in the rearward direction; and a front sight assembly that minimizes lateral shift or drift of the sight pin during firing.

6 Claims, 10 Drawing Sheets

REVOLVER FOR FIRING HIGH VELOCITY AMMUNITION

CROSS-REFERENCE TO RELATED APPLICATIONS

This application claims benefit of U.S. Provisional Application Ser. No. 60/627,491, filed Nov. 12, 2004; and is a continuation of U.S. Utility application Ser. No. 11/270,944, filed Nov. 10, 2005, now U.S. Pat. No. 7,254,913, both of the foregoing hereby incorporated by reference in their entirety.

TECHNICAL FIELD

The present invention relates generally to firearms and, more particularly, to revolvers having modified structures that are adapted for the firing of high velocity ammunition.

BACKGROUND OF THE INVENTION

High velocity ammunition is well known for use in rifles and other long guns. Ammunition of this type is characterized by muzzle velocities in excess of 2,500 feet per second (fps). Handguns, however, have not been capable of muzzle velocities of this magnitude, and have an upper bound of about 1,500 fps. Revolvers present the added challenge of a barrel-cylinder (BC) gap to allow for cylinder rotation. In such revolvers, the hot gases generated by the ignition of the powder are vented out the cylinder and down the barrel, with some venting at the BC gap, with a concomitant loss of pressure and bullet velocity. The BC gap must be established and uniformly maintained between the forward-most surface of the chamber and the rearward-most surface of the barrel to ensure that proper cylinder pressures are maintained during firing. In revolvers in which the barrels are threaded to the frame so as to extend through a rearward-facing portion of the frame, methods for setting the BC gap include broaching the rearward surface of the barrel after the barrel is threaded into the frame. This broaching method produces tool marks on the end surface of the barrel adjacent the cylinder and oftentimes mars the finish of the barrel.

The use of high velocity ammunition causes a more powerful and intense release of the high-pressure gases from the cartridge casings upon firing. Correspondingly, a greater acceleration of the bullet from the cartridge is realized with the projectile traveling from the cylinder across the BC gap to the barrel. The greater force necessary to achieve muzzle velocities in the range of 2,500 fps generates forces of a magnitude that can cause cartridge brass to flow in a rearward direction and somewhat increased bullet deformation. Standard geometries at the rearward end of the barrel (at which the bullet enters) include tapered or chamfered surfaces to facilitate the engagement of the deformed projectile. Standard constant twist rifling allows the projectile to be sufficiently engaged and longitudinally rotated at a constant rate as the projectile traverses the length of the barrel.

Certain high-powered revolvers have a shroud placed over the barrel and can therefore have a releasably secured sight assembly mounted at the forward end of the shroud. Such sight assemblies usually employ known mounting arrangements to ensure proper sight alignment and positive sight retention. These replaceable sight assemblies generally comprise sights with a dovetail base that are urged by springs in the forward direction such that forward edges of the sights engage laterally-positioned mounting pins. With this releasable sight configuration, there sometimes is displayed an undesirable lateral shift or drift of the laterally-positioned pin due to the forces associated with high velocity ammunition. In such cases, the sights correspondingly shift with the laterally-positioned mounting pins.

What is needed is a revolver firearm that is capable of reliably firing high velocity ammunition and that addresses these and other special circumstances found with operating a handgun in this extreme range of muzzle velocities.

SUMMARY OF THE INVENTION

An embodiment of the present invention relates to a firearm for firing high velocity ammunition, provided in the form of a revolver that includes a frame, a cylinder, a firing mechanism, and a barrel, all of which are operably interconnected in a manner similar to a standard revolver. For example, the cylinder is pivotally mounted in the frame and includes a plurality of chambers configured to receive and align cartridges with the barrel, while the firing mechanism includes a trigger and a hammer, wherein upon a user pressing the trigger in a rearward direction, the hammer is operated to discharge a cartridge loaded into one of the chambers.

One advantage of the revolver of the present invention is that a space between a rearward portion of the barrel and a forward surface of the cylinder can be adjusted longitudinally within a shroud housing the barrel from a forward end of the barrel. Such adjustment is typically effected by the use of one or more spacers. By allowing the position of the barrel to be adjusted in such a manner, the need to broach the rearward surfaces of the barrel is eliminated.

Another advantage is that the barrel is provided with a forcing cone integrally formed at the rearward opening thereof. The forcing cone (and/or the rear surface of the barrel) can be polished or otherwise finished to provide a reflective surface that reduces the amount of erosion that can result from using the revolver with high velocity ammunition. Thus, because the surface of the cone is subject to less erosion, the barrel life of the handgun can be extended. Furthermore, the geometry of the surface of the cone in conjunction with the reflective finish allows the projectile of the high velocity ammunition to show a smoother translation across the BC gap, thereby showing improved performance results in the revolver.

Another advantage of the present invention is the use of gain-twist rifling in the barrel that allows for a more gradual engagement of the high velocity projectile with the rifling and further allows for a smoother transition to the full velocity of the projectile as the projectile exits the barrel. Moreover, by using a preferred electrochemical process to produce the rifling, variations in land width and profile, as well as a smoother transition to the full twist rate, can be realized.

Yet another advantage of the present invention is the optional provision of a larger diameter, hardened firing pin bushing that allows for improved support at the head of the cartridge casing. By utilizing a larger bushing (e.g., a bushing in which the diameter thereof is at least as large as the casing head), brass flow in the rearward direction may be minimized when high velocity ammunition is fired.

Still another advantage of the present invention is an interchangeable front sight assembly with a lateral locating pin having a dumbbell-shaped configuration. Such a configuration minimizes lateral shift or drift of the sight pin during the firing of high velocity ammunition from the handgun.

DETAILED DESCRIPTION OF THE PREFERRED EMBODIMENT

Figure 1:
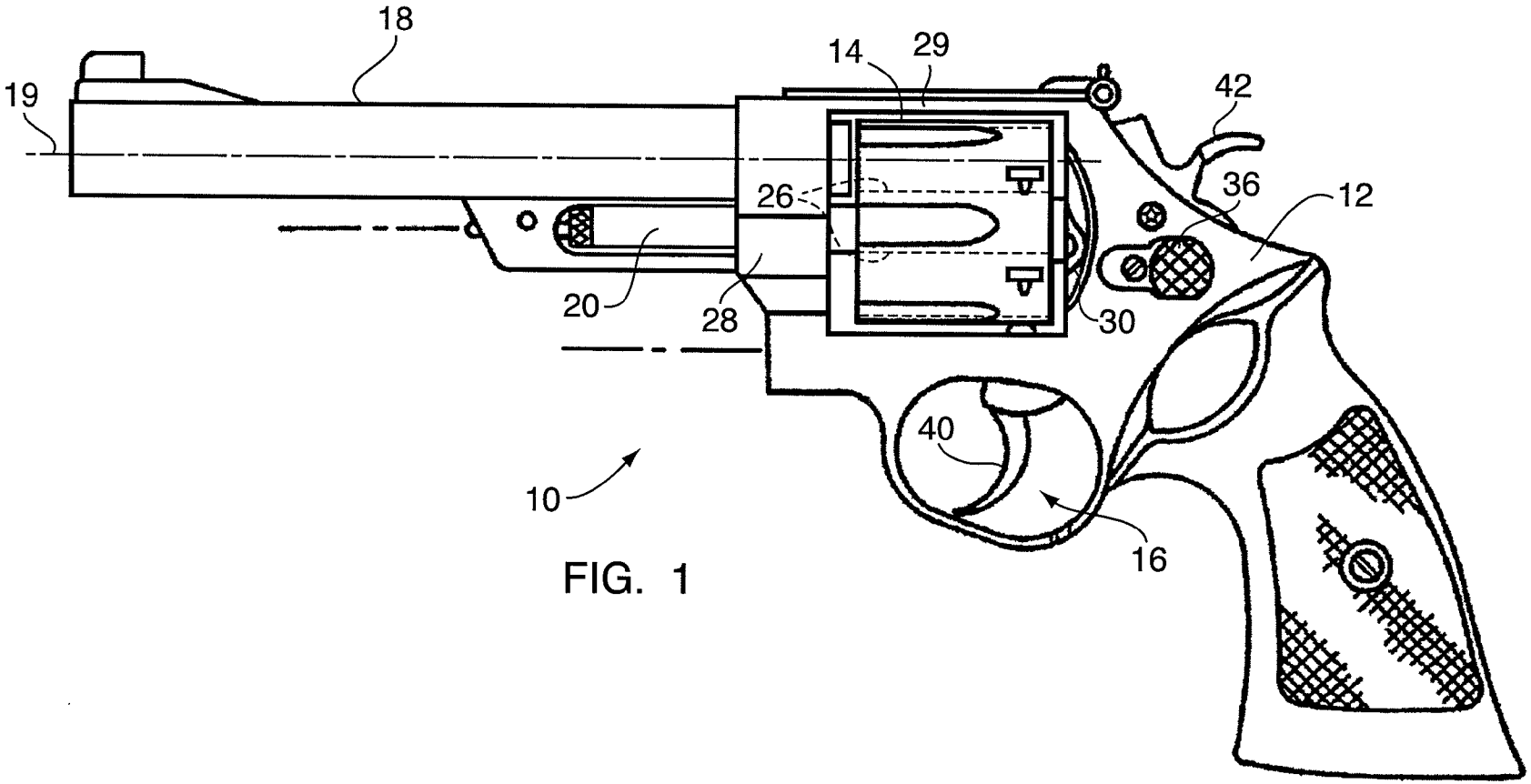
FIG. 1 is a simplified schematic representation of a handgun made in accordance with the present invention.

Referring to FIG. 1, one exemplary embodiment of a firearm incorporating the present invention is shown generally at 10 and is hereinafter referred to as "firearm 10." The firearm 10 is preferably a revolver (as described in U.S. Pat. Nos. 6,330,761 and 6,523,294, which are incorporated herein by reference) that includes a frame 12, a cylinder 14, a firing mechanism 16, and a barrel 18. A firing axis 19 extends coaxially with the barrel 18. High velocity ammunition is the preferred type of ammunition for use in the firearm 10, such ammunition typically being capable of attaining bullet muzzle velocities of about 2,500 feet per second or greater.

The cylinder 14 is pivotally mounted in the frame 12 and includes an ejector 20, a ratchet 22, and a plurality of chambers, two of which are shown at 26. The chambers 26 are configured to receive and align cartridges with the barrel 18. The cylinder 14 is pivotally mounted on a yoke 28 that is attached to the frame 12. A top strap 29 extends across a top portion of the frame 12 from a forward portion to a rearward portion to define a generally rectangular aperture. When the cylinder 14 is closed with respect to the yoke 28, the cylinder 14 is positioned in the rectangular aperture such that a chamber 26 of the cylinder 14 is longitudinally aligned with the barrel 18. A retaining mechanism 30 maintains the cylinder 14 within the rectangular aperture. A cylinder release bar actuated by a thumb piece 36 allows the cylinder 14 to be rotated out of the rectangular aperture into a cylinder-open position.

The firing mechanism 16 includes a trigger 40 and a hammer 42. Upon a user pressing the trigger 40 in a rearward direction, the hammer 42 is operated to discharge a cartridge loaded into the firearm 10.

Figure 2:
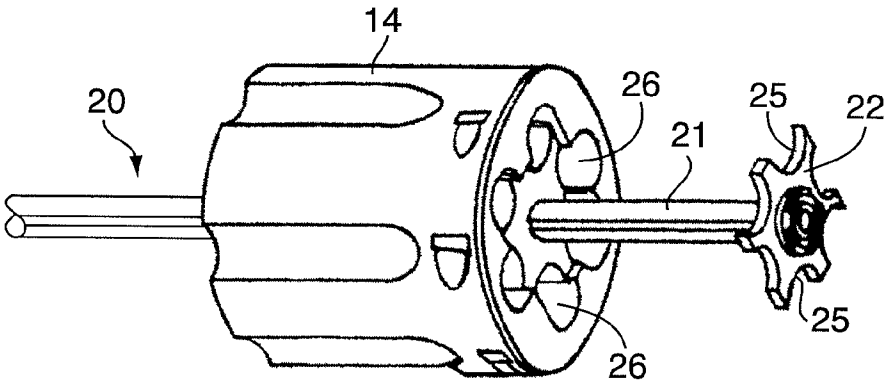
FIG. 2 is a perspective view of a cylinder and ejector of the handgun of FIG. 1.

Referring now to FIG. 2, the ejector 20 includes a rod 21 about which the cylinder 14 rotates. The ratchet 22 is attached at a rearward end of the rod 21 and has a plurality of detent or cut out portions 25 that correspond to the respective rearward edges of each chamber 26. The ratchet 22 is dimensioned such that it is received in a recess at the rear surface of the cylinder 14 so as not to obstruct the rotation of the cylinder 14 on the yoke 28 or the opening and closing of the cylinder 14 in the rectangular aperture. Upon loading a cartridge into any chamber 26, a rim on a base of the casing of the cartridge engages the cut out portion 25 of the ratchet 22. To eject cartridges from the cylinder 14, the firearm is placed in the cylinder-open position and a forward end of the rod 21 is urged in the rearward direction. The defining edges of each cut out portion 25 engage the rims of the casings, and the casings are pulled out of the rear of the cylinder 14.

Figure 3:
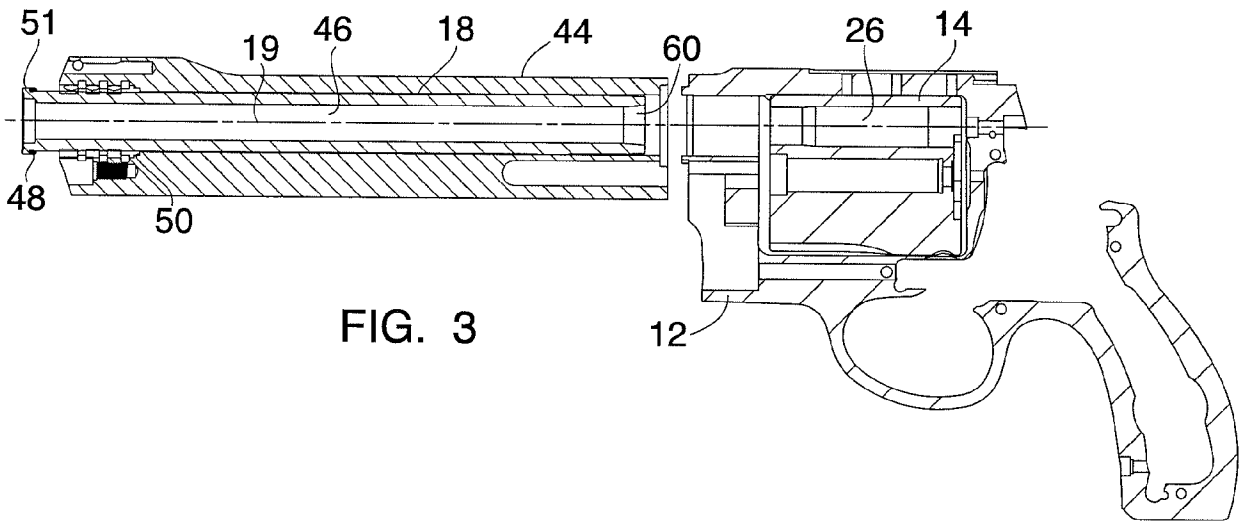
FIG. 3 is a simplified schematic representation of the handgun of FIG. 1 in exploded cutaway view.
Figure 4:
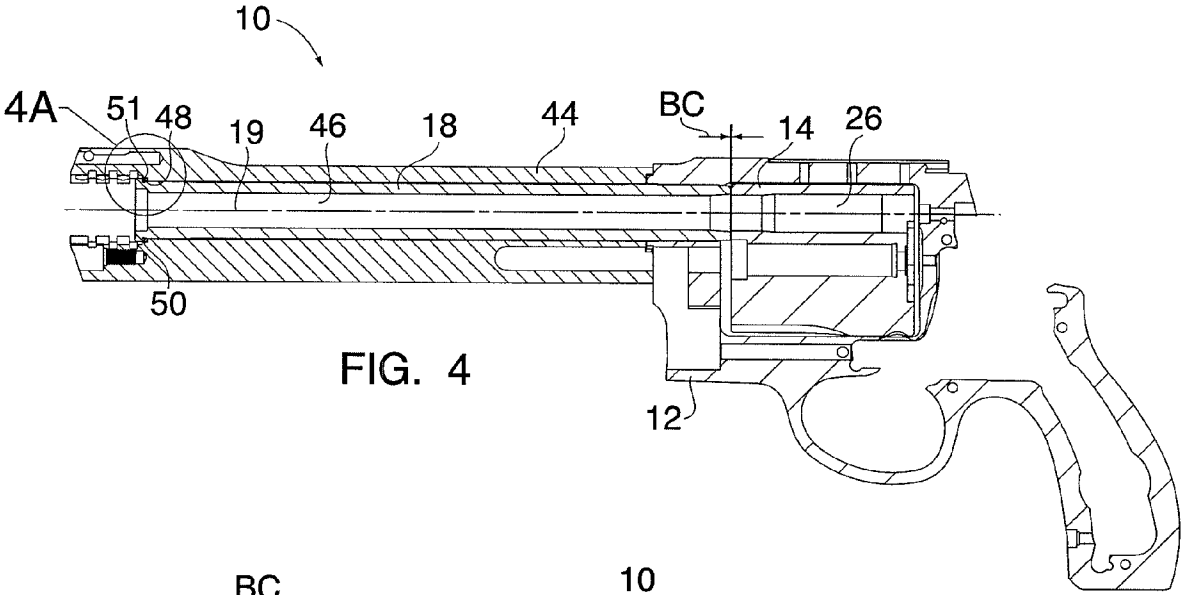
FIGS. 4, 4A, and 5 are simplified schematic representations of the handgun of FIG. 1 in cutaway view.
Figure 5:
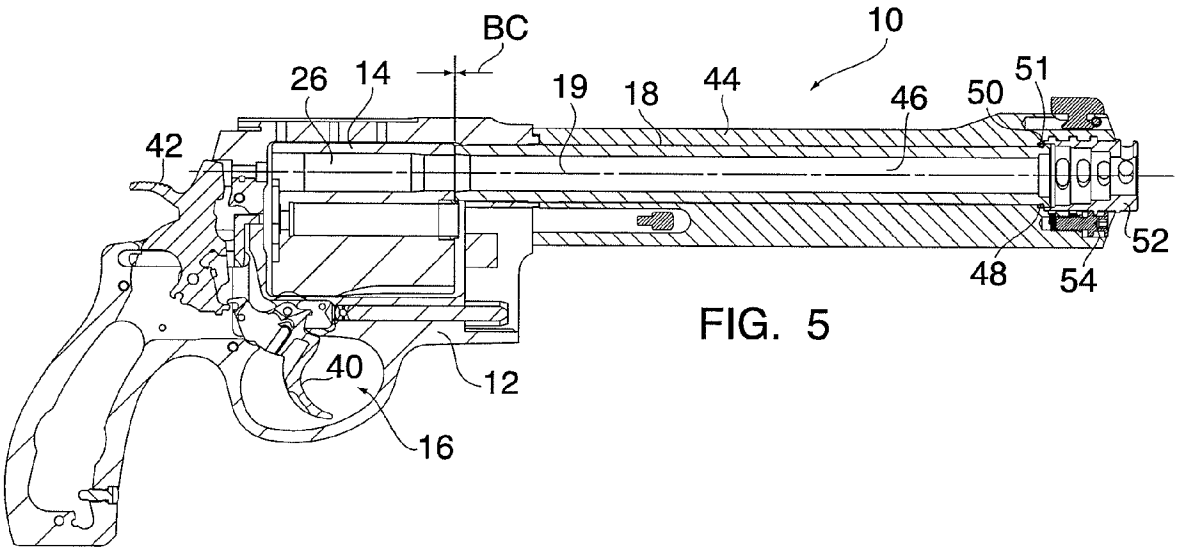

Referring now to FIGS. 3-5, the barrel 18 is mounted in a shroud 44 attached to a forward portion of the frame 12. (The shroud 44 may be considered part of the frame 12, i.e., part of the support structure of the firearm.) The barrel 18 comprises an elongated, substantially cylindrical member having a cylindrical bore 46 extending longitudinally there through. The surfaces of the barrel 18, namely, the rearward-most edge surface at which the projectile enters the barrel and the wall of the cylindrical bore 46, are polished or otherwise finished to provide a reflective surface such that the hot gases generated during the firing of ammunition are less likely to have an effect on the barrel surfaces. For example, the reflective surface may be a highly reflective surface (by which it is meant a surface with a reflectance or albedo of at least 0.85) or a mirrored surface (a reflectance/albedo of at least 0.95). Upon assembly of the revolver, the cylindrical bore 46 registers with the respective chambers 26 of the cylinder 14 and forms the longitudinal firing axis 19.

Figure 4A:
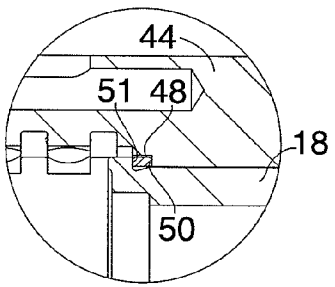

The clearance between the forward-most surface of the cylinder 14 and the rearward-most surface of the barrel 18 is the barrel-cylinder (BC) gap. The barrel 18 is mounted in the shroud 44 using a spacer 48 positioned at a forward end of the barrel 18 to give the desired BC gap (see FIG. 4A for a detail view). The spacer 48, which may be annular-shaped, washer like device, is positioned against a flange 50 on the shroud 44. The fore end of the barrel 18 may also be provided with a flange 51 for abutting the spacer 48 when the firearm 10 is assembled. Alternatively, the spacer 48 may be removably connected to the barrel in a standard manner. The width of the spacer 48 is selected to give the desired BC gap. Alternatively, two or more spacers 48 can be stacked together on the barrel 18 to adjust the BC gap. Thus, because the BC gap is adjusted via the spacer(s) 48, the threading of the barrel into the frame and the broaching operation in which the rearward portion of the barrel is cut off (potentially marring the polished barrel surface) is avoided. A muzzle brake 52 (FIG. 5) fits over the forward end of the barrel 18 and is positioned in the shroud 44. The muzzle brake 52 is held in the shroud 44 using a screw 54 or similar device.

Figure 6:
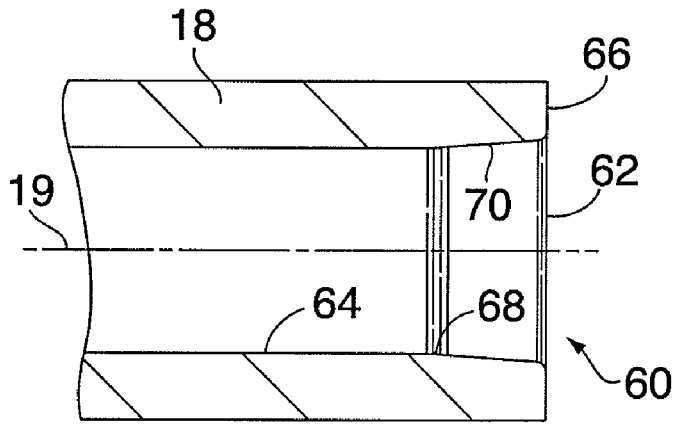
FIG. 6 is a simplified schematic representation of a barrel of the handgun of FIG. 1 showing a forcing cone.

Referring now to FIG. 6, a forcing cone 60 is integrally formed with the barrel 18 at the rearward opening thereof. The forcing cone 60, which accommodates for the deformation of the projectile as the projectile traverses the BC gap, comprises a rearward edge 62 that is defined by the perimeter of the rearward opening of the barrel 18. The forcing cone 60 extends radially inward toward the firing axis 19 to terminate at the inner wall 64 of the barrel 18. Thus, the forcing cone 60 has a slightly larger entry diameter as compared to the central bore diameter of the barrel 18, thereby providing a clearance between the cylinder and the barrel 18 to facilitate movement of a projectile (e.g., bullet) from the cylinder to the barrel 18.

In particular, the slightly larger entry diameter of the forcing cone 60 enables the projectile to enter the barrel 18 with a reduced probability that the projectile will engage a rearward-facing surface 66 of the barrel 18.

The rearward edge 62 of the forcing cone 60 is configured to have a radius (e.g., it is rounded) to further facilitate the movement of the projectile from the cylinder into the forcing cone 60. A forward edge 68 of the forcing cone 60 may be likewise configured to have a radius to even further facilitate the movement of the projectile from the forcing cone 60 to the barrel 18. A wall 70 of the forcing cone 60 adjacent the rearward edge 62 may be provided with a reflective finish (e.g., a highly reflective or mirrored surface) to allow hot gases to flow more smoothly and to reduce the opportunity for the surface of the forcing cone 60 to erode.

Figure 7:
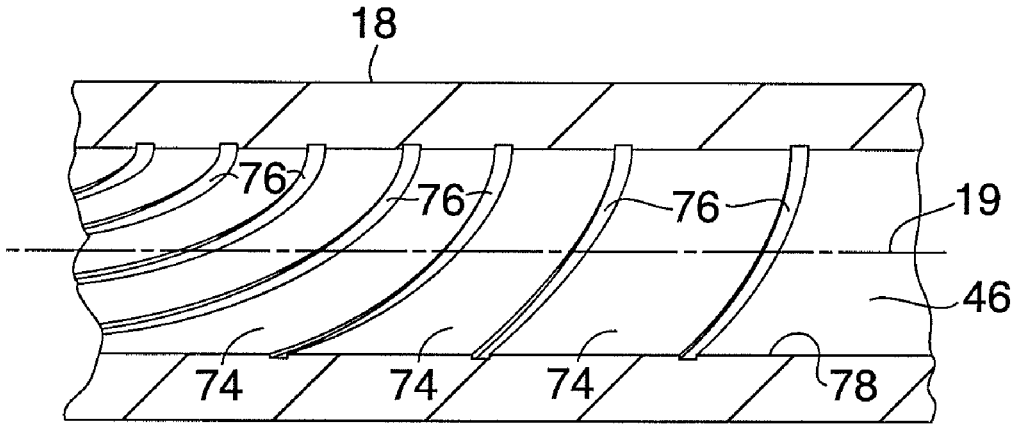
FIG. 7 is a simplified schematic representation of a barrel of the handgun of FIG. 1 showing gain-twist rifling.

Referring now to FIG. 7, lands 74 and grooves 76 are disposed on an inner wall 78 of the cylindrical bore 46 of the barrel 18 to form gain-twist rifling. Gain-twist rifling is characterized by a twist rate (turns per unit distance) that varies along the length of the barrel from a slow twist at the breech/rear end of the barrel to a tighter twist at the muzzle/fore end of the barrel, e.g., from a slow rate such as one twist per 100 inches to a higher rate such as one twist per 20 inches. The gain-twist rifling of the present invention may be produced on the inner wall 78 using an electrochemical process that produces rifling in which the width of the lands 74 increases as the twist rate increases, thereby allowing more of the bullet surface to be engraved as the bullet traverses the length of the barrel 18. Essentially, as the lands get wider, the bullet is gripped tighter as it spins faster. This is different from conventional grain-twist rifling, where the full land and groove profiles are engraved initially, and then the twist rate is increased. One exemplary electrochemical process for producing rifling in gun barrels is disclosed in U.S. Pat. No. 5,819,400, which is incorporated herein by reference in its entirety. Gain-twist rifling lessens the abrupt transition from zero angular velocity to the nominal or maximum angular velocity. The smoother transition up to the nominal or maximum angular velocity has been found to increase accuracy by minimizing bullet deformation as it engraves the rifling. Furthermore, users may feel less recoil torque because of the bullets' smoother transition to maximum angular velocity.

As noted, the lands 74 closest to the breech end of the barrel (near the forcing cone 60) may be smaller in width. The edges of these lands will typically not be as sharp as those of the lands further down the barrel where the twist rate is increased. In particular, the edges of the lands proximate to the forcing cone may be provided with smoother or more rounded edges, as a result of the electrochemical process or otherwise. This results in a reduction of bore erosion ahead of the forcing cone.

Figure 8:
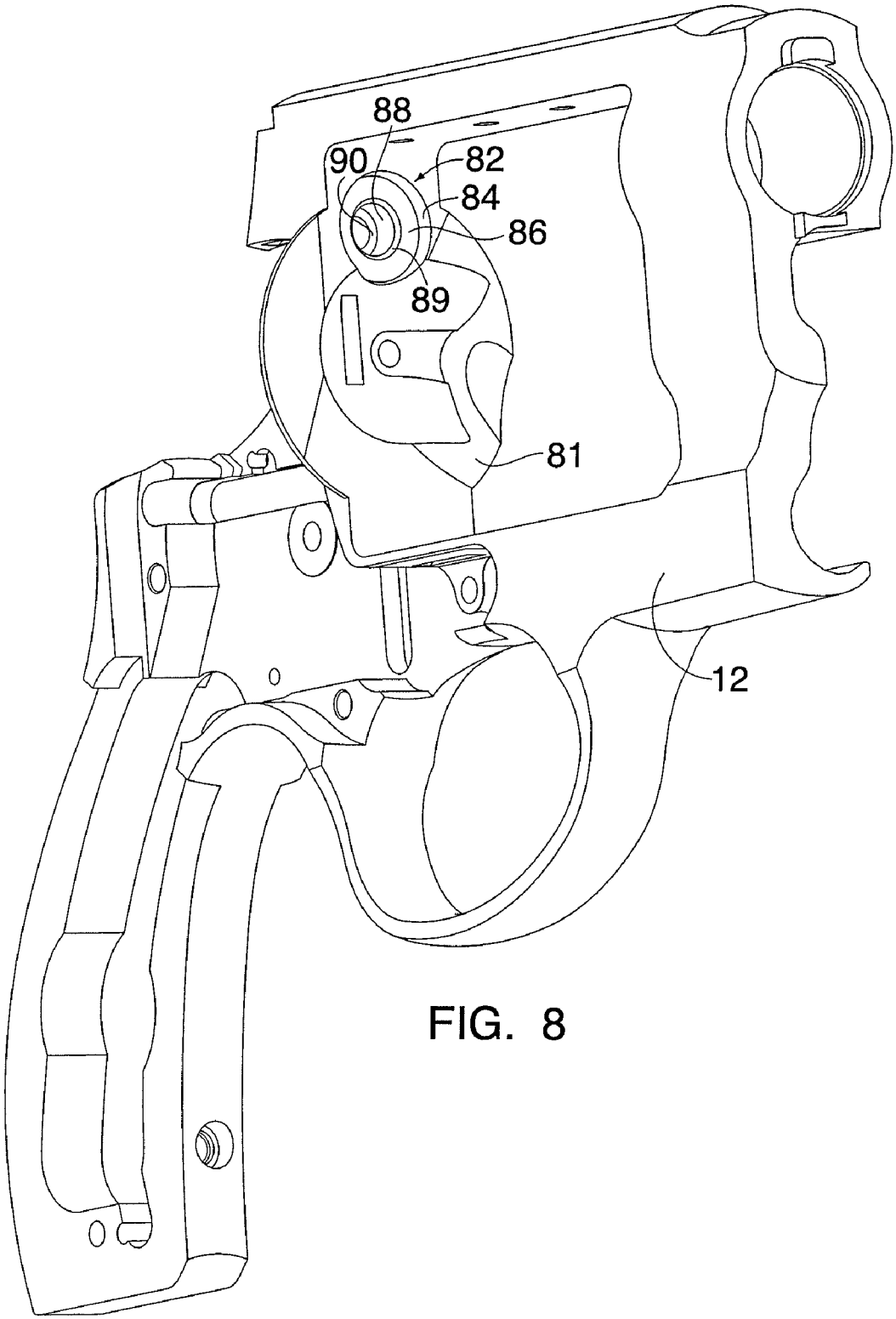
FIG. 8 is a perspective view of a portion of a frame of the handgun of FIG. 1.
Figure 9:
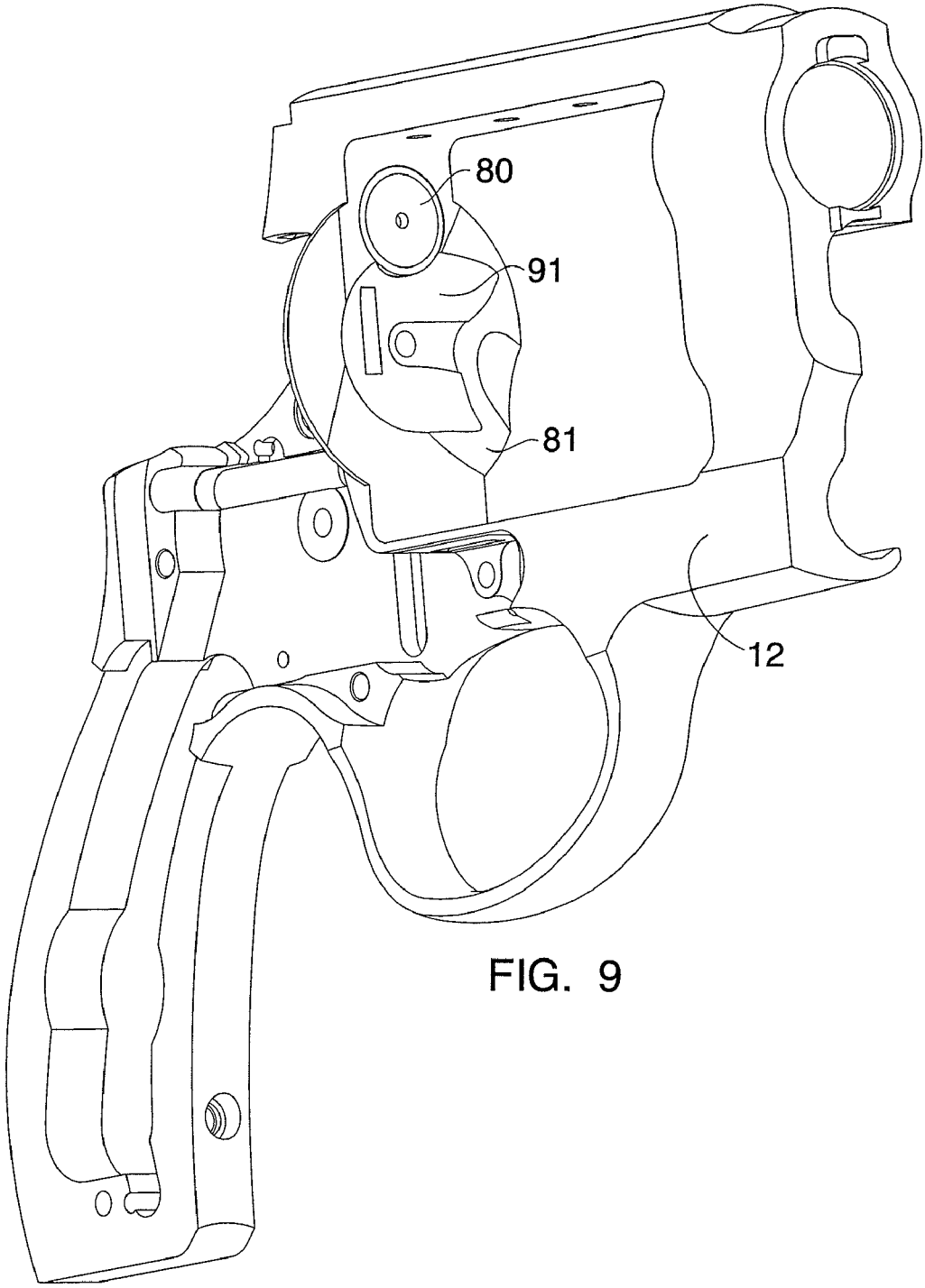
FIG. 9 is a perspective view of the frame of the handgun of FIG. 8 showing a firing pin bushing mounted in a yoke of the frame.
Figure 10:
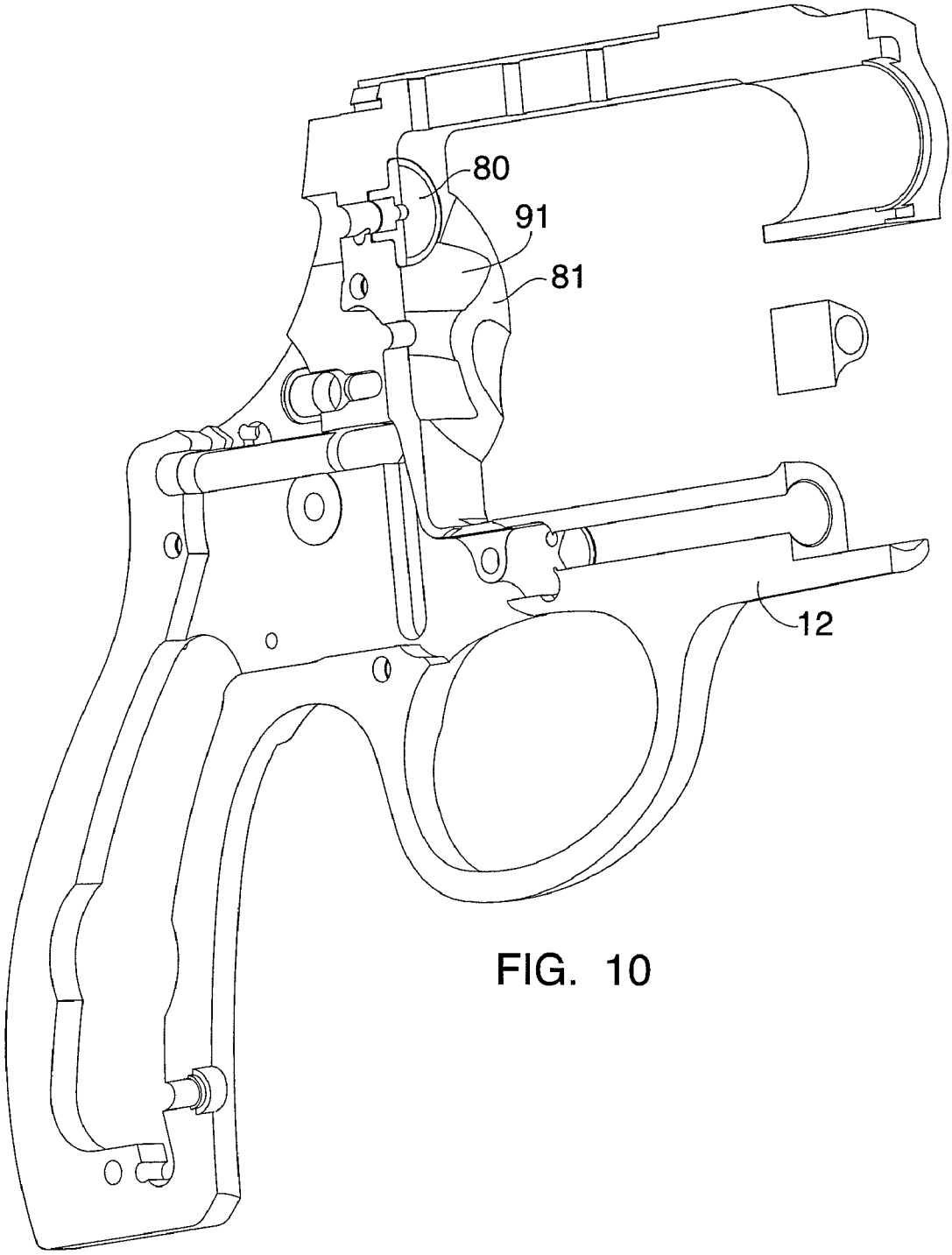
FIG. 10 is a perspective view of the firing pin bushing of the handgun of FIG. 9 mounted in the yoke of the frame and shown in cutaway view.

Referring now to FIGS. 8-13, the firearm also incorporates a firing pin bushing 80 having a diameter (or other widest dimension if the bushing is non-circular) that meets or exceeds the diameter of the head of the cartridge casing used in the handgun. As is shown in FIG. 8, the firing pin bushing 80 is mounted in a recess 82 in a forward-facing, bolster face portion 81 of the frame 12. The recess 82 is defined by a first vertical surface 84, a first land 86, a second vertical surface 88, and a second land 90. A chamfered rim 89 defines the edge between the first land 86 and the second vertical surface 88. The lands and vertical surfaces of the recess 82 are sufficient to accommodate the firing pin bushing 80 with a degree of precision such that the firing pin bushing 80 can be mounted with a minimum amount of angular displacement from the flush surface of the bolster face 81 at the upper portion thereof. Referring to FIG. 9, a lower portion of the firing pin bushing 80 extends into a cavity or recess 91 in the bolster face 81.

Figure 11:
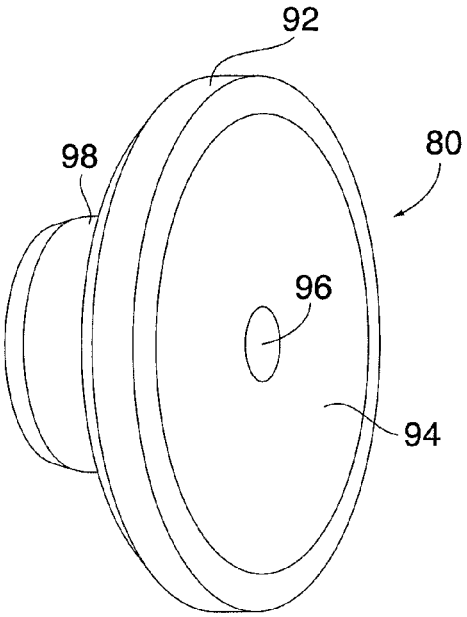
FIGS. 11 and 12 are perspective views of the firing pin bushing for a revolver made in accordance with the present invention.
Figure 12:
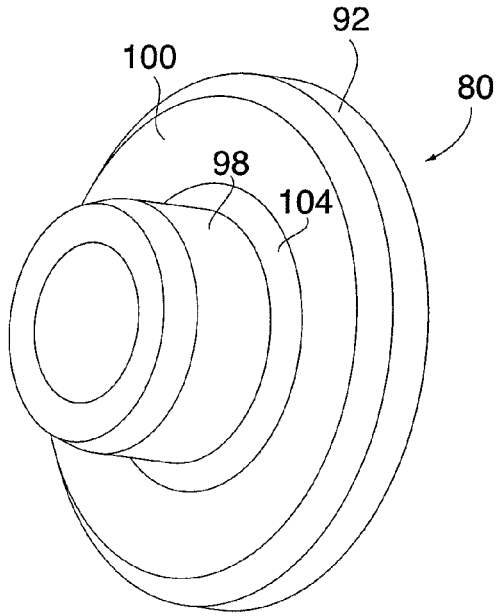
Figure 13:
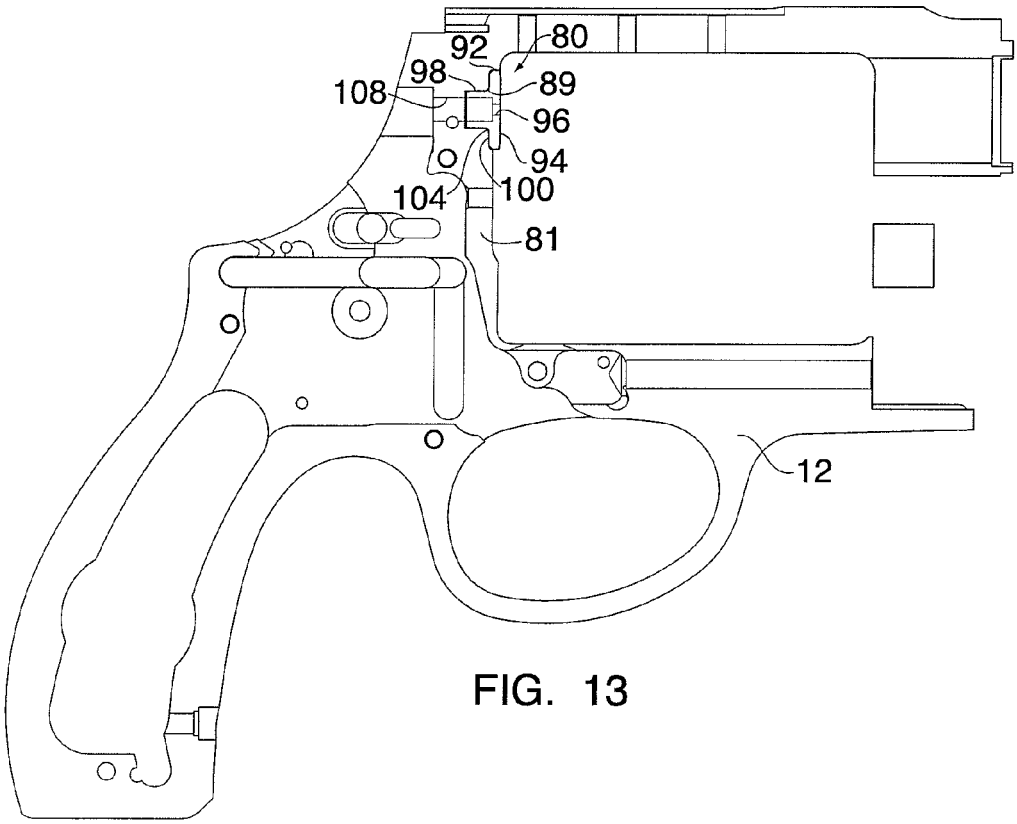
FIG. 13 is a side elevation view of the frame and firing pin bushing of FIG. 9.

Referring now to FIGS. 11-13, the firing pin bushing 80 comprises a primary member 92 having a planar front face 94, a firing pin aperture 96 drilled, bored, machined, cast, or otherwise formed in the center of the primary member 92 so as to extend therethrough, and a seating member 98 extending from a rearward face 100 of the primary member 92. The primary member 92 may be disc- or plate-shaped, i.e., shaped akin to a washer or squat cylinder, and the seating member 98 is preferably generally cylindrical in shape and concentrically positioned relative to the firing pin aperture 96.

The width dimension of the front face 94 is at least as great as the diameter of a cartridge casing head used in the firearm to prevent brass flow during the use of high-pressure ammunition. As can be best seen in FIGS. 11 and 13, the perimeter of the front face 94 has a radius, i.e., its outer edge is rounded. The perimeter of the rearward face 100 (FIGS. 12 and 13) is chamfered to facilitate the insertion of the firing pin bushing 80 into the recess. A transition surface 104 between the rearward face 100 and the outer wall of the seating member 98 is concavely radiused to provide a space between the chamfered rim 89 and the firing pin bushing 80. The rearward-most edge of the seating member 98 is chamfered at an angle of about 30 degrees to even further facilitate the insertion of the firing pin bushing 80 into the recess. As can best be seen in FIG. 13, the diameter of the aperture of the seating member 98 is greater than the diameter of the firing pin aperture. The aperture of the seating member 98 registers with a bore 108 in the yoke 28 through which the firing pin (not shown) translates to extend through the firing pin aperture 96 to engage a cartridge.

Figure 14:
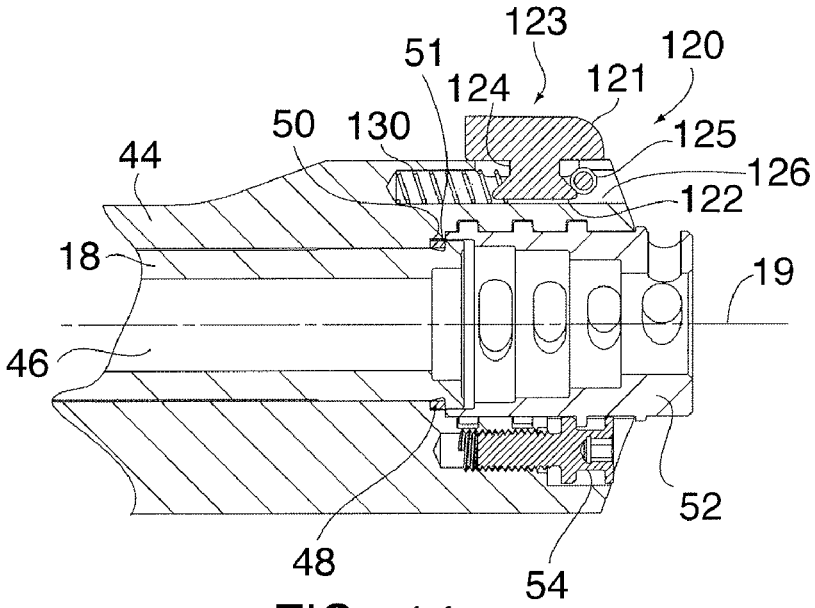
FIG. 14 is a side elevation view of a front sight assembly on the forward end of the barrel of a revolver made in accordance with the present invention.

Referring to FIG. 14, the firearm incorporates a front sight assembly 120 that is mountable into the shroud 44. The sight assembly 120 of the present invention is an improvement on the sight assembly of U.S. Pat. No. 5,802,757, which is incorporated herein by reference in its entirety. The sight assembly 120 of the present invention includes a sight 123 having a sight pin portion 121 and an anchor portion 122. The anchor 122 is attached to or connected to the sight pin 121 via a connector 124, which is of a lesser width-wise dimension than either the sight pin 121 or the anchor 122. The anchor 122 is received in a slot 126 on the uppermost surface of the forward portion of the shroud 44. The anchor 122 and the receiving slot 126 extend longitudinally in the direction of the longitudinal firing axis of the firearm. In mounting the sight 123, the anchor 122 is press-fitted into the receiving slot 126 such that the connector 124 and the anchor 122 engage a laterally mounted dumbbell-shaped pin 125 that is positioned across the receiving slot 126 perpendicular to the direction in which the slot 126 and the longitudinal firing axis extend. A spring 130 mounted in the rearward portion of the receiving slot 126 is configured to urge the anchor 122 (and, accordingly, the connector 124 and the sight 121) in a forward direction against the dumbbell-shaped pin 125.

Figure 15:
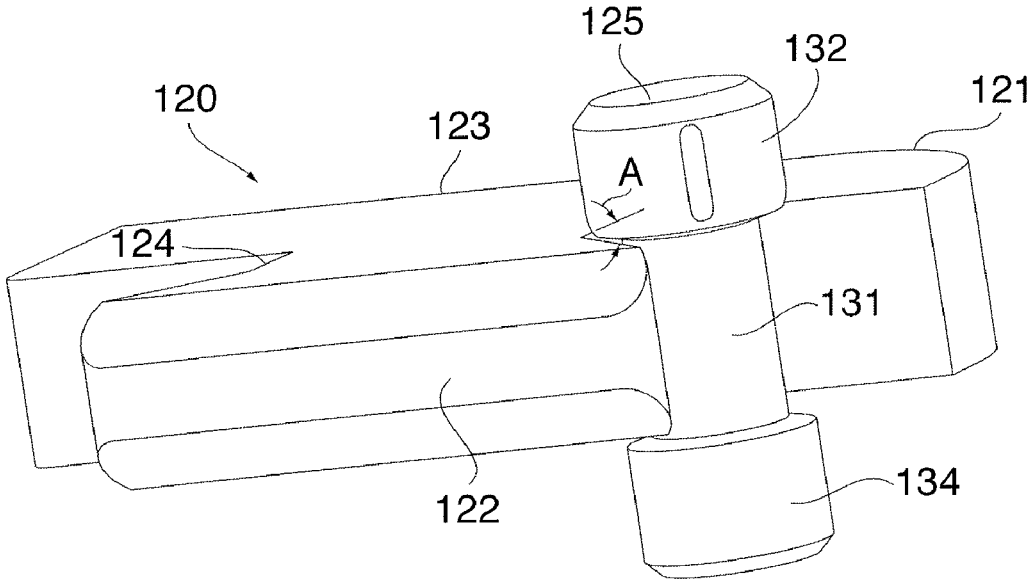
FIG. 15 is a perspective view of the front sight assembly of FIG. 14.

Referring now to FIG. 15, the dumbbell-shaped pin 125 comprises a dowel-shaped connection member 131, a first protrusion 132 attached to a first end of the connection member 131, and a second protrusion 134 attached to a second end of the connection member 131. A forward surface of the connector is substantially vertical and perpendicular to the longitudinal firing axis when the sight 123 is mounted in the shroud. A forward surface of the anchor 122 is tapered such that when the connector 124 and the anchor 122 are attached to each other or integrally formed, an angle A is defined. Upon urging the anchor 122 and the connector 124 against the dumbbell-shaped pin 125, the dowel-shaped connection member 131 is received in a vertex of the angle A. The first protrusion 132 and the second protrusion 134 capture the anchor 122 and the connector 124 there between, thereby facilitating the retention of the sight assembly 120 in place.

Figure 16:
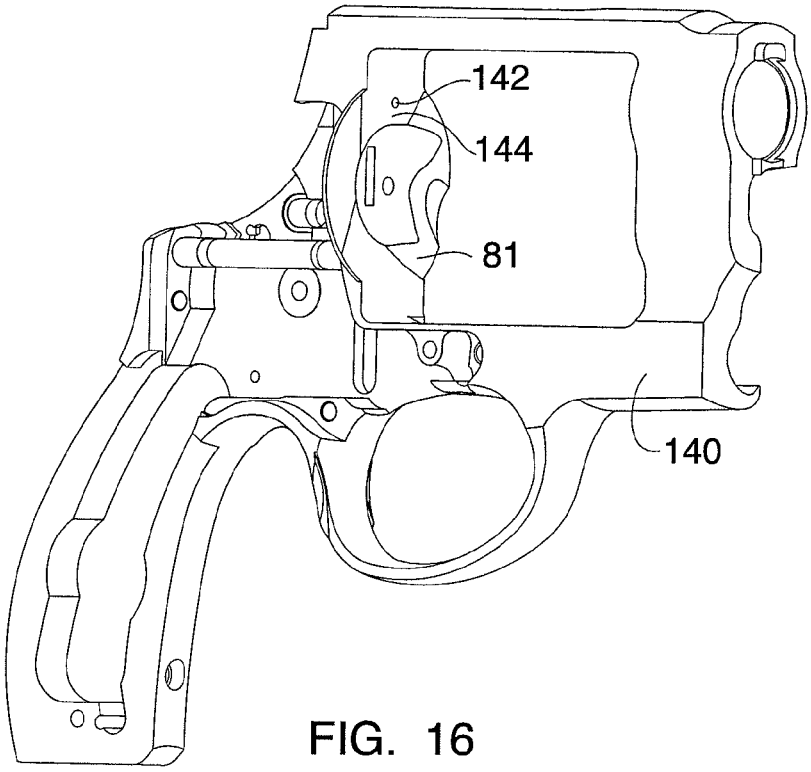
FIGS. 16 and 17 are perspective and side elevation cross-section views, respectively, of a bushing-less, hardened frame according to an alternative embodiment of the present invention.
Figure 17:
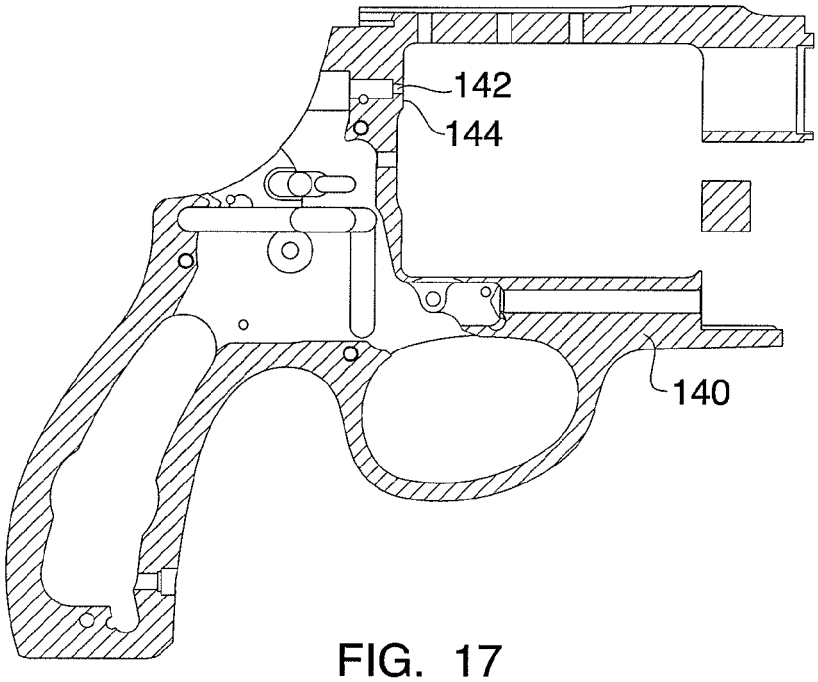

FIGS. 16 and 17 show a "bushing-less" frame 140 according to an alternative embodiment of the present invention. The frame 140 is not provided with an enlarged firing pin bushing 80 (as shown in FIGS. 8-13) or other type of firing pin bushing. Instead, the frame 140 has a firing pin aperture 142 formed directly in the frame and extending there through, and the area 144 of the frame around the aperture (e.g., the bolster face 81) is hardened using standard methods. Optionally, the entire frame 140 may be hardened. As should be appreciated, traditional firing pin bushings present a "seam" in the bolster face proximate the casing head, as between the bushing and frame. With high velocity ammunition, the brass casing may start to flow into the seam, jamming the cylinder. With the enlarged bushing 80, the seam is moved away from the casing head. With the bushing-less frame 140, the seam is eliminated entirely.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above disclosure.

What is claimed is:

1. A firearm for firing high velocity ammunition, the firearm comprising:

a frame;

a barrel connected to the frame;

a cylinder pivotally attached to the frame and positioned within an opening in the frame and having at least one chamber operatively aligned with the barrel for housing a round of ammunition; and a firing pin bushing connected to the frame, wherein the firing pin bushing has a front face facing the at least one chamber, said firing pin bushing including a generally cylindrical primary member defining the front face and having a firing pin aperture extending there through from the front face to a rearward face of the primary member, and a generally cylindrical seating member extending from the rearward face of the primary member and having a seating member aperture extending there through, said seating member aperture being concentrically positioned with respect to the firing pin aperture and having a diameter greater than a diameter of the firing pin aperture;

wherein the firing pin bushing is mounted in a recess in the frame complementary in shape to the firing pin bushing; and wherein the recess includes a first vertical surface, a first land, a second vertical surface and a second land, and a chamfered rim defining an edge between the first land and the second vertical surface.

2. The firearm of claim 1, wherein:

the primary member is disc shaped.

3. The firearm of claim 1, wherein:

a perimeter of the front face is rounded.

4. The firearm of claim 1, wherein:

a perimeter of the rearward face is chamfered to facilitate the insertion of the firing pin bushing in the recess.

5. The firearm of claim 1, wherein the firearm bushing further comprises:

a transition surface between the rearward face and an outer wall of the seating member, said transition surface being concavely radiused.

6. The firearm of claim 1, wherein:

the rearward-most edge of the seating member is chamfered to facilitate insertion of the firing pin bushing into the recess.

* * * * *